United States Patent [19]

Ferraguti

[11] 4,014,186

[45] Mar. 29, 1977

[54] METHOD OF FORMING A CLOSED END ON A KNITTED TUBULAR FABRIC

[75] Inventor: Luigi Ferraguti, Condove (Turin), Italy

[73] Assignee: Matec S.p.A., Scandicci (Florence), Italy

[22] Filed: Jan. 2, 1976

[21] Appl. No.: 646,104

[30] Foreign Application Priority Data

Mar. 12, 1975 Italy ..... 67621/75

[52] U.S. Cl. ..... 66/95; 66/187; 66/173; 66/14

[51] Int. Cl.[2] ..... D04B 15/02; D04B 9/54; D04B 9/56

[58] Field of Search ..... 66/187, 14, 95, 173

[56] References Cited

UNITED STATES PATENTS

| | | | |
|---|---|---|---|
| 3,327,500 | 6/1967 | Currier | 66/187 |
| 3,548,614 | 12/1970 | Boyer, Jr. et al. | 66/187 X |
| 3,575,019 | 4/1971 | Janda | 66/187 |
| 3,685,320 | 8/1972 | Gorini | 66/187 X |
| 3,714,801 | 2/1973 | Janda | 66/187 X |
| 3,721,111 | 3/1973 | Billi | 66/187 |
| 3,768,277 | 10/1973 | Uhlir | 66/187 X |
| 3,800,563 | 4/1974 | Billi | 66/187 |
| 3,884,052 | 5/1975 | Findlay et al. | 66/187 |
| 3,938,355 | 2/1976 | Conti | 66/187 X |

*Primary Examiner*—Mervin Stein
*Assistant Examiner*—A. M. Falik
*Attorney, Agent, or Firm*—Sughrue, Rothwell, Mion, Zinn & Macpeak

[57] ABSTRACT

A method for forming a closed end on a tubular knitted fabric, such as a stocking, on a circular knitting machine, in which two annular tubular layers are formed as continuations of the tubular knitted fabric at separate stages by needles operating in the same cylinder of the machine. The two layers are supported on separate circles of support members while a relative rotation through at least 180° between the circles of support members is effected, and a final few rows of substantially run-proof close knitting are made before the fabric is cast-off from the needles.

4 Claims, 9 Drawing Figures

FIG. 5
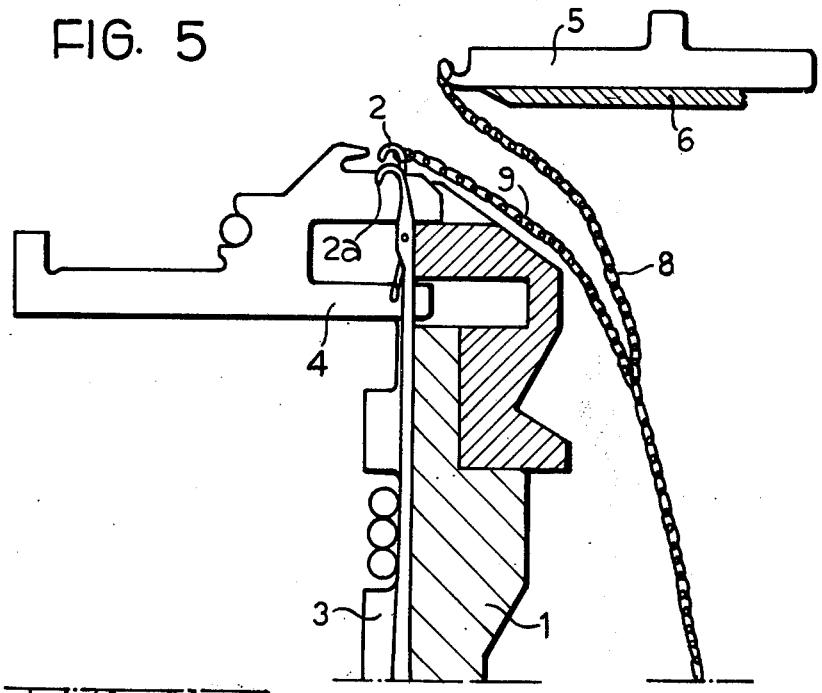
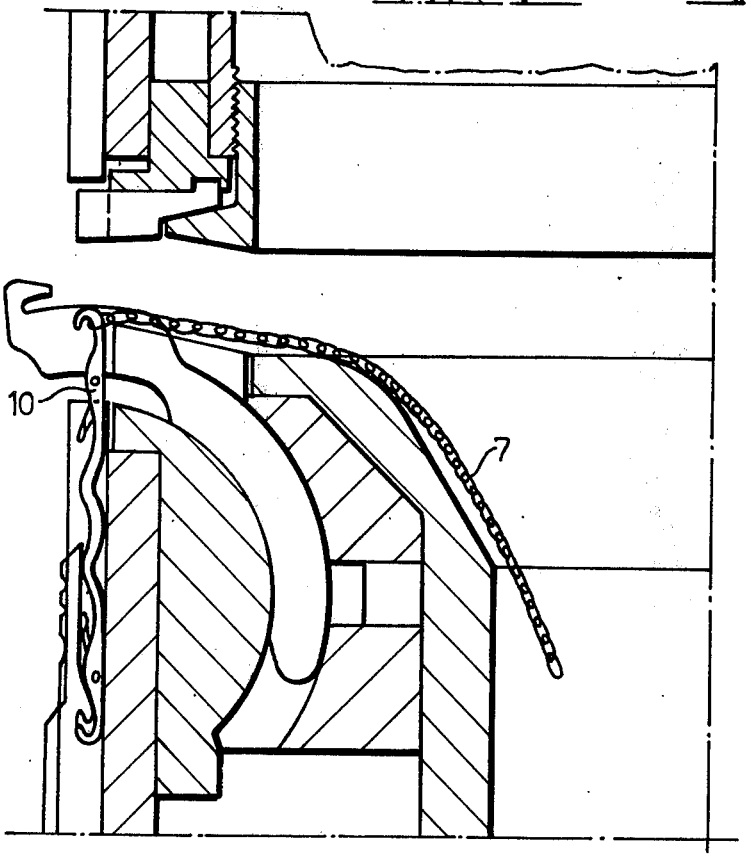
FIG. 6

METHOD OF FORMING A CLOSED END ON A KNITTED TUBULAR FABRIC

BACKGROUND OF THE INVENTION

This invention relates to a method of forming a closed end on a knitted tubular fabric, particularly on a stocking, using a circular knitting machine.

In a known method of forming such an end, the tubular fabric is held on supporting members (which may consist of the circular array of dial hooks in a one-cylinder machine or may comprise some of the needles transferred to the upper cylinder in a two cylinder machine) while a further section of tubular fabric is formed by action of needles in a lower needles-cylinder, and relative rotation between the circle of support members and the lower needle cylinder through at least 180° is effected. The loops held on the said support members are then transferred to the needles of the lower cylinder which effectively doubles the said further section of tubular fabric.

After the transfer, which, together with twisting of the fabric due to the relative rotation referred to above, brings about closure of the end, a few more rounds of virtually run-proof close stitching are knitted before casting-off from the cylinder needles is effected. These rounds of close stitching form in effect a small cord at the edge of the double fabric, away from the closed end.

When the aforesaid system is used for making a stocking it suffers from the disadvantage that, owing to the formation of the small cord, the stocking has limited elasticity and stretch, precisely in a region where this elasticity and stretch are most required. Moreover, the presence of the cord generally causes annoyance to the user when walking since it exerts unpleasant pressure upon the sole of the foot.

For this reason it has already been proposed to form the closed end of a tubular fabric, particularly at the end of a stocking, by forming two separate layers of fabric, supporting the free end of one layer on a circle of support members while twisting the layers relative to each other, and then transferring the end of the said layer from its supporting members to the needles of the lower cylinder. This results in the cord which consists of the rounds or rows of close finishing-off stitching being close to the toe end of the tubular fabric, rather than at the edge of the double fabric away from this closed toe end, or in any case closer to the toe end than the aforesaid edge of the tubular fabric.

According to a known process, after the last row of the tubular fabric has been formed, an inner and an outer annular layer of tubular fabric, both continuous with the aforesaid tubular fabric, are formed. The end of the inner layer is held upon support members arranged in a circle whilst the end of the outer tubular layer is held on the needles of the lower cylinder of the machine, and a relative rotation through at least 180° is effected between the said circle of support members and the cylinder. The loops held upon the said support members are then transferred on to the needles of the lower cylinder, and a few turns or rows of substantially run-proof close stitching, are made before the fabric is cast-off.

In the foregoing method the inner and outer layers of the double fabric of the closed end are formed simultaneously, the inner layer by the action of the support members and the outer by the action of at least some of the needles of the lower cylinder of the machine.

This method can be used with either a two-cylinder circular machine or with a single cylinder circular machine which is, however, of a special type, in which there is a series of horizontal cam-controlled needles in the radial grooves of the dial.

In the first case, some of the needles, e.g. alternate needles of the lower cylinder, are transferred to the upper cylinder, and the outer layer of the double fabric is made by the needles operating in the lower cylinder, whilst the inner layer of the fabric is made by the needles operating in the upper cylinder, and it is therefore necessary to have at least two thread guides, one of which feeds the yarn to the needles of the lower cylinder and the other to those of the upper cylinder. Upon completion of the two layers the two cylinders are rotated relatively to each other through at least 180°, and the needles operating in the upper cylinder are transferred to the lower cylinder, after which all the needles carry out a few rounds of substantially run-proof close knitting, to form the small finishing-off cord which will thus be closer to the closed end than to the other edge of the double fabric.

In the second case, the inner layer of the double fabric is made by the horizontal needles on the dial, and the respective free edge is transferred, after rotation of the dial relative to the cylinder has been effected, to the needles of the lower cylinder, which then carry out the turns or rows of close finishing-off stitches.

This known process does, however, have some serious disadvantages which render its reliability, or even the possibility of its practical embodiment on an industrial scale, questionable.

In both cases it is impossible with the previously known method to use a machine capable of knitting according to a single system. Thus a one-cylinder circular knitting machine of the simplest and most widely used type, having a dial furnished with hooks, cannot be used.

The object of this invention is to avoid this disadvantage and to provide a highly reliable method which can be carried out without difficulty with any type of circular stocking knitting machine, having either two-cylinders or a single-cylinder, even with only one operating system, so long as it is provided with a mechanism allowing reciprocal rotation between the two cylinders or between the cylinder and the dial.

SUMMARY OF THE INVENTION

According to this invention there is provided a method for forming a closed end on a tubular knitted fabric, particularly on a stocking, on a circular knitting machine, in which, after the last row of tubular fabric has been formed by the needles slidably assembled in grooves in the lower cylinder, or the cylinder, of the machine, an inner and an outer annular tubular layer are formed as continuations of the tubular fabric, the loops at the free edge of the inner layer are then held on support members arranged in a circle and the free edge of the outer tubular layer is held by the needles of the said cylinder until a relative rotation of at least 180° between the said circle of support members and the said cylinder has been effected, when the loops held on the said support members are transferred to the needles of the said cylinder for the making of a final few turns or rows of substantially runproof close knitting before the fabric is cast-off from the needles, characterised in that the double fabric of the toe is formed by the use of the needles carried by the said cylinder, successively in two sections, the inner layer being formed first by some of the needles of the cylinder, the outer layer then being formed by the remaining needles of the said cylinder whilst the free edge of the inner layer remains held on the support members arranged in a circle above the said cylinder.

If the method is carried out with a single-cylinder machine, the free edge of the inner layer is held on the hooks of the dial during fashioning of the outer layer of the double fabric. However, if it is carried out with a two-cylinder machine, the free edge of the inner layer is held on the lower hooks of the needles which have made the said layer and which, have been transferred to the upper cylinder of the machine.

BRIEF DESCRIPTION OF THE DRAWINGS

Other characteristics and advantages of the invention will emerge from the following description, given by way of non-limiting example, with reference to the attached drawings, which show a first embodiment using a single-cylinder circular machine and a second embodiment using a two-cylinder circular machine, and in which:

FIGS. 1 to 5 show diagrammatically, in longitudinal section, the essential members for the formation of the knitted fabric on a one-cylinder circular machine, in the position which these members assume during some of the successive stages of operation of the method according to the first embodiment of the invention, and FIGS. 6 to 9 show diagrammatically, also in longitudinal section, some essential members of a two-cylinder circular machine, in the positions which these members assume during the operation of the method according to the second embodiment of the invention.

In all the Figures the elements corresponding to one another are designated by the same reference numbers.

DETAILED DESCRIPTION OF THE ILLUSTRATED EMBODIMENTS

Figure 1:
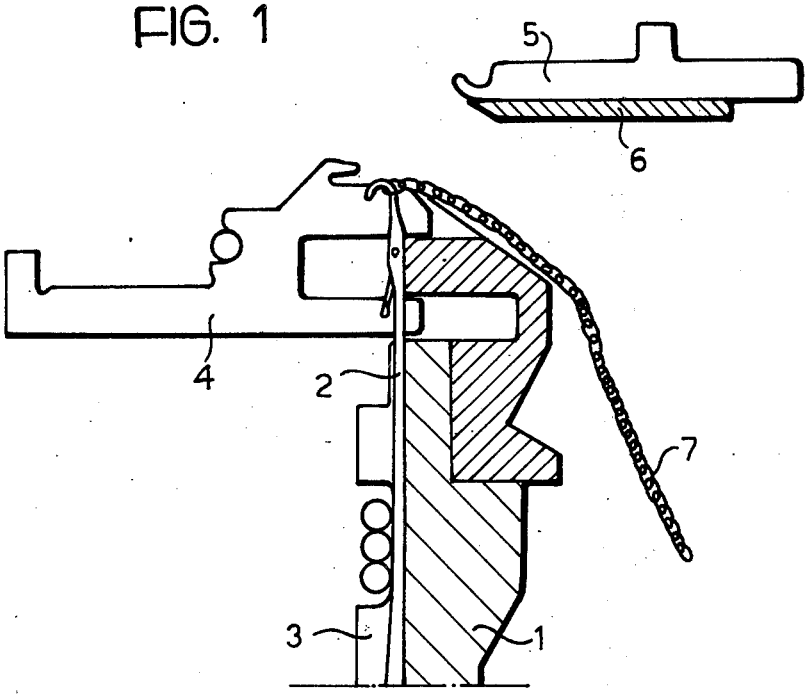
Figure 2:
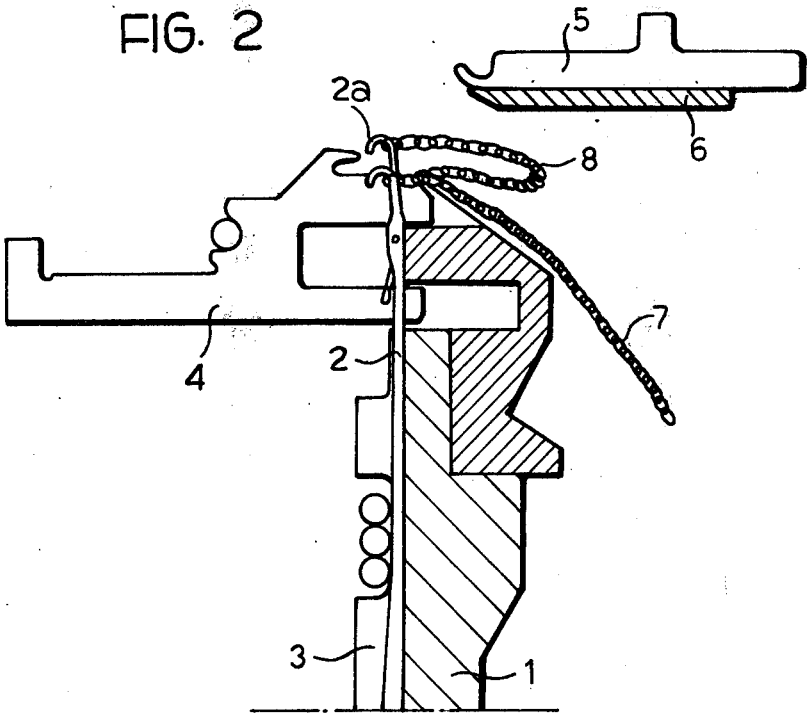

In FIGS. 1 to 5 part of the cylinder of the machine is shown as 1, one of the even needles is shown as 2 and one of the odd needles as 2*a*. The machine has a circular dial 6, part of which is shown. The needle 2 is slidingly assembled in a corresponding axial groove 3 of the cylinder 1. A holding-down sinker is shown at 4, and a hook 5, corresponding to the needle 2*a* is shown slidingly assembled in a radial groove in the dial 6.

Also illustrated in FIG. 1 is the tubular fabric 7 of the stocking held on the needles 2 at the beginning of formation of the closed toe end of the stocking.

Other portions of the machine are not illustrated since they are known per se and are irrelevant for the purpose of understanding this invention.

In order to form the toe the odd needles 2*a* are first caused to form an inner tubular-layer 8, (see FIG. 2) whilst the even needles 2 hold the tubular body 7 of the stocking.

Figure 3:
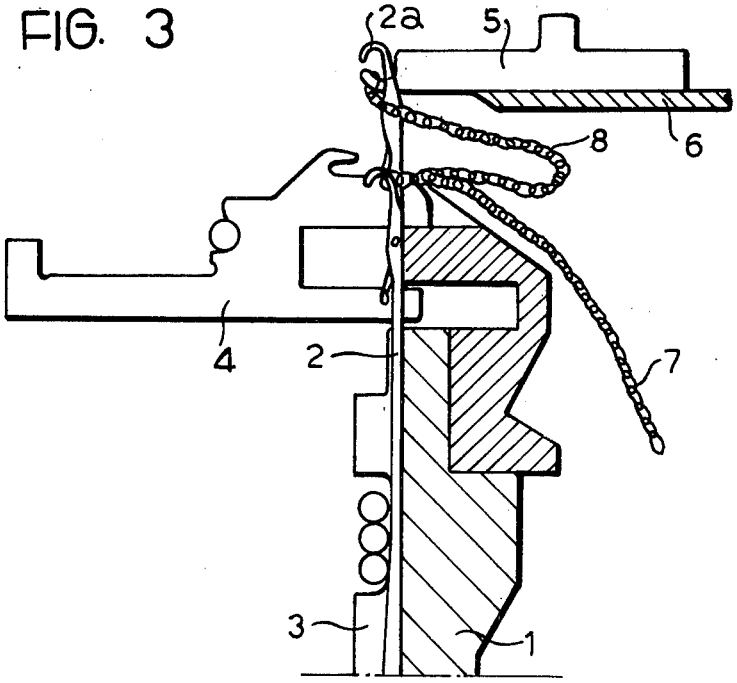

When the inner tubular layer 8 is completed, the odd needles 2*a* transfer the loops of the free end of the said layer to the hooks 5. This stage is illustrated in FIG. 3.

Figure 4:
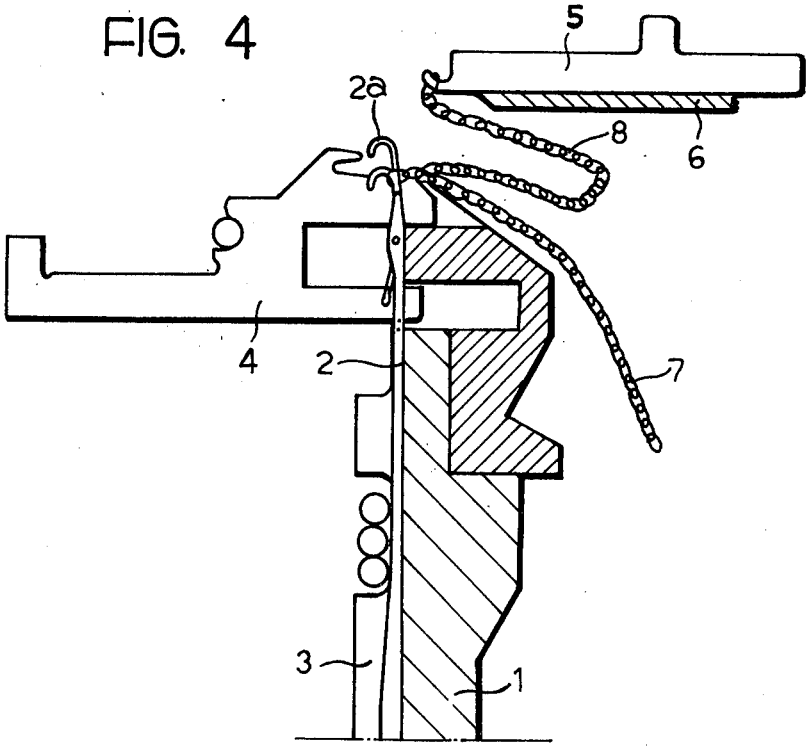

When this transfer is effected, the odd needles 2*a* withdraw whilst the even needles 2 come up into the working position illustrated in FIG. 4 in order to start forming an outer tubular layer 9.

This stage ends (see FIG. 5) when the even needles 2 have formed a section of the outer tubular layer 9 of a length approximately equal to that of the inner layer 8.

Next the closure stage (not illustrated) is carried out, involving first the rotation of the needle cylinder 1 relative to the dial 6 through an angle of at least 180°. Then all the needles are raised again and the odd ones 2*a* take back the knitting from the hooks 5, after which all the needles are put into operation to join together the layers 8 and 9 and to make a few rows of close knitting designed to be substantially run proof.

When circular machines with two cylinders, one above the other are used, the inner and outer layers 8 and 9 of the double fabric of the toe are formed in a similar manner by the needles operating in the lower cylinder only.

The various stages of the operation using a two-cylinder circular machine are illustrated in FIGS. 6 to 9 in which the even and odd double-ended needles are shown by the reference numbers 10 and 10*a* respectively. The upper cylinder, part only of which is shown, is indicated by reference numeral 11 and has axially extending grooves 12 for guiding the needles.

In FIG. 6 the initial stage is illustrated in which all the needles hold the end of the tubular body 7 of the stocking.

Figure 7:
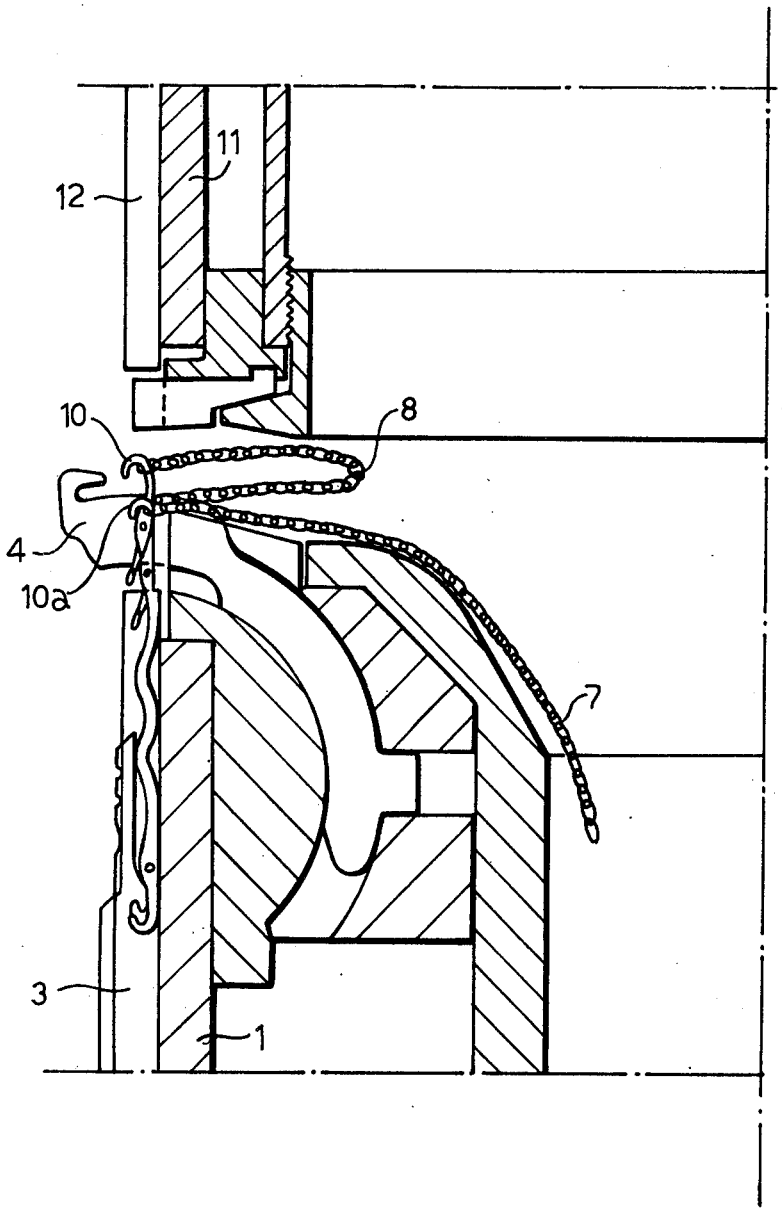
Figure 8:
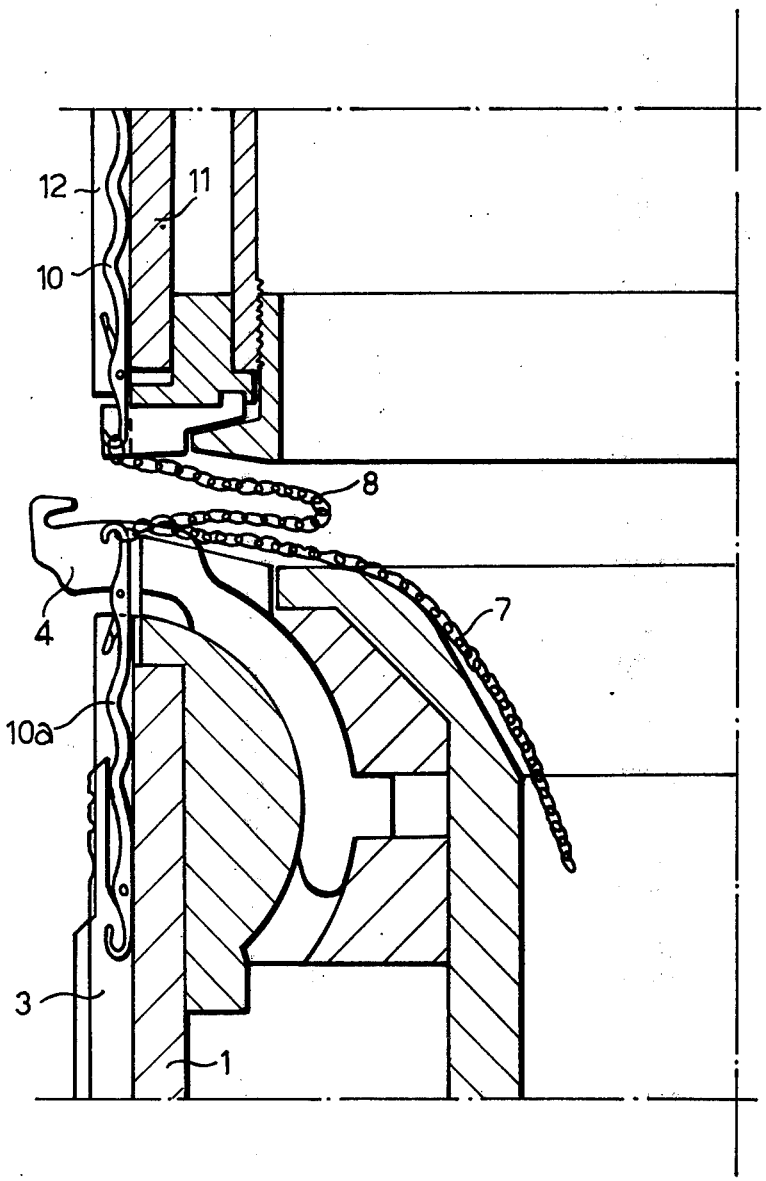
Figure 9:
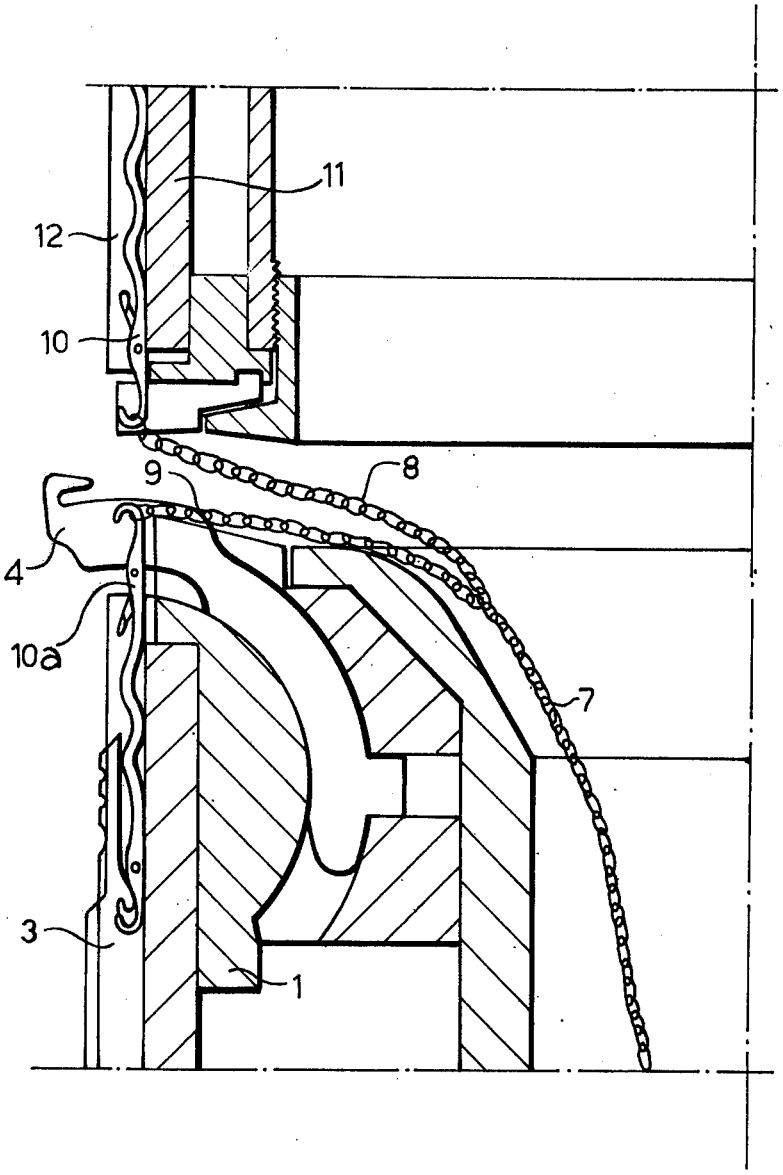

FIG. 7 shows how the even needles 10 form the inner tubular layer 8 of the double fabric of the toe, whilst the odd needles 10*a* hold the tubular body 7 of the stocking. On completion of the inner layer 8 the even needles 10 are transferred into the upper cylinder 11 and (see FIG. 8) they hold the layer 8 with their lower hooks, whilst the tubular body 7 remains attached to the odd needles 10*a*.

At this point the odd needles 10*a* are brought into operation to form the outer tubular layer 9 of the double fabric of the toe. This stage again finishes when the outer layer 9 reaches a length approximately equal to that of the inner layer 8. During this stage the tubular body 7 of the stocking gradually descends towards the inside of the lower cylinder 1.

There then follows the closure stage, in which the lower cylinder 1 is caused to rotate in relation to the upper one 11 through an angle of at least 180°. The even needles 10 are then caused to return into the lower cylinder 1 and all the needles are put into action to join the layers 8 and 9 and to form the "casting-off" section consisting of a few rows of close knitting, which will then be close to the closed toe of the stocking.

It will be understood that without departing from the principle of the invention details of the equipment used for carrying out the invention can vary widely from what has been described and illustrated purely by way of example.

Thus, for example, when a single-cylinder knitting machine is used, dials can be employed which have horizontal needles instead of simple hooks, and the inner and outer layers of the double fabric of the toe can be fashioned by groups of differently arranged needles instead of by alternate even and odd needles respectively.

What is claimed is:

1. A method for forming a closed end on a tubular knitted fabric, particularly on a stocking, on a circular knitting machine having upper and lower cylinders, wherein, after the last row of tubular fabric has been formed by the needles slidably assembled in grooves in the lower cylinder, an inner and an outer annular tubular layer are formed as continuations of the tubular fabric, the loops at the free edge of the inner layer are held on support members arranged in a circle and the free edge of the outer tubular layer is held by the needles of the said cylinder until a relative rotation of at least 180° between the said circle of support members and the said cylinder has been effected, when the loops held on the said support members are transferred to the needles of the said lower cylinder for the making of a final few turns or rows of substantially run-proof close knitting before the fabric is cast-off from the needles, wherein the improvement consists in forming the double fabric of the toe by the use of the needles carried by the said lower cylinder, successively in two sections, the inner layer being formed first by some of the needles of said lower cylinder, the outer layer then being formed by the remaining needles of the said cylinder whilst the free edge of the inner layer remains held on the support members arranged in a circle above said lower cylinder.

2. The method defined in claim 1, wherein the free edge of the inner layer is held on the lower hooks of the needles of the knitting machine which have formed this layer and which has been transferred into the upper cylinder of the machine.

3. A method for forming a closed end on a tubular knitted fabric, particularly on a stocking, on a circular knitting machine having a single cylinder and a cooperating circular dial, wherein, after the last row of tubular fabric has been formed by the needles slidably assembled in grooves in the lower cylinder, an inner and an outer annular tubular layer are formed as continuations of the tubular fabric, the loops at the free edge of the inner layer are held on support members arranged in a circle and the free edge of the outer tubular layer is held by the needles of the said cylinder until a relative rotation of at least 180° between the said circle of support members and the said cylinder has been effected, when the loops held on the said support members are transferred to the needles of the said cylinder for the making of a final few turns or rows of substantially runproof close knitting before the fabric is cast-off from the needles, wherein the improvement consists in forming the double fabric of the toe by the use of the needles carried by the said cylinder successively in two sections, the inner layer being formed first by some of the needles of said cylinder, the outer layer then being formed by the remaining needles of the said cylinder whilst the free edge of the inner layer remains held on the support members arranged in a circle above said cylinder.

4. The method defined in claim 3, wherein the free edge of the inner layer is held on hooks of the dial during forming of the outer layer of the double fabric.

* * * * *